US011645991B2

(12) United States Patent
Chen

(10) Patent No.: US 11,645,991 B2
(45) Date of Patent: May 9, 2023

(54) METHODS FOR DEBUGGING AND USING OVERDRIVE BRIGHTNESS VALUE LOOK-UP TABLE, AND DISPLAY PANEL

(71) Applicant: HKC CORPORATION LIMITED, Shenzhen (CN)

(72) Inventor: Wei Chen, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 179 days.

(21) Appl. No.: 17/296,258

(22) PCT Filed: Dec. 5, 2019

(86) PCT No.: PCT/CN2019/123234

§ 371 (c)(1),
(2) Date: May 24, 2021

(87) PCT Pub. No.: WO2020/134939

PCT Pub. Date: Jul. 2, 2020

(65) Prior Publication Data

US 2022/0223116 A1 Jul. 14, 2022

(30) Foreign Application Priority Data

Dec. 24, 2018 (CN) ..... 201811579703.9

(51) Int. Cl.
*G09G 3/36* (2006.01)

(52) U.S. Cl.
CPC ..... *G09G 3/3648* (2013.01); *G09G 3/3607* (2013.01); *G09G 2320/0233* (2013.01); *G09G 2340/16* (2013.01)

(58) Field of Classification Search
CPC ..... G09G 3/3648; G09G 3/3607; G09G 2320/0233; G09G 2340/16; G09G 3/006;
(Continued)

(56) References Cited

U.S. PATENT DOCUMENTS 6,519,722 B1 * 2/2003 Wiggins ..... G06F 5/06 714/707
9,390,663 B2 7/2016 Schutten et al.
(Continued)

FOREIGN PATENT DOCUMENTS

CN 1873760 A 12/2006
CN 101425266 A 5/2009
(Continued)

OTHER PUBLICATIONS

Ruishuang Wang, the International Searching Authority written comments, dated Mar. 2020, CN.
(Continued)

*Primary Examiner* — Antonio Xavier

(57) ABSTRACT

The present application discloses methods for debugging and using an overdrive brightness value look-up table, and a display panel. The debugging method includes the following steps: measuring actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table.

16 Claims, 4 Drawing Sheets

(58) Field of Classification Search
CPC ..... G09G 3/3688; G09G 2320/0285; G09G 2320/0693; G09G 3/3406; G09G 3/3413
See application file for complete search history.

(56) References Cited

U.S. PATENT DOCUMENTS

| | | | | |
|---|---|---|---|---|
| 10,339,881 | B1 * | 7/2019 | Tung | G09G 3/3607 |
| 2008/0036715 | A1 * | 2/2008 | Lee | G09G 3/3648 345/87 |
| 2011/0227941 | A1 * | 9/2011 | Huang | H04N 9/73 345/596 |
| 2013/0039204 | A1 * | 2/2013 | Dorize | G06F 1/3287 370/252 |
| 2017/0092208 | A1 * | 3/2017 | He | G09G 3/3648 |
| 2018/0204529 | A1 * | 7/2018 | Chen | G09G 3/36 |
| 2019/0005900 | A1 * | 1/2019 | Chen | G09G 3/3607 |

FOREIGN PATENT DOCUMENTS

| | | | |
|---|---|---|---|
| CN | 101425267 | A | 5/2009 |
| CN | 101764924 | A | 6/2010 |
| CN | 109410850 | A | 3/2019 |
| TW | 201124978 | A | 7/2011 |

OTHER PUBLICATIONS

Ruishuang Wang, the international Searching Report, dated Mar. 2020, CN.

* cited by examiner

METHODS FOR DEBUGGING AND USING OVERDRIVE BRIGHTNESS VALUE LOOK-UP TABLE, AND DISPLAY PANEL

The present application claims priority to Chinese Patent Application No. CN201811579703.9, filed with the China National Intellectual Property Administration on Dec. 24, 2018 and entitled "METHODS FOR DEBUGGING AND USING OVERDRIVE BRIGHTNESS VALUE LOOK-UP TABLE, AND DISPLAY PANEL", which is incorporated herein by reference in its entirety.

TECHNICAL FIELD

The present application relates to the field of display technologies, and in particular, to methods for debugging and using an overdrive brightness value look-up table, and a display panel.

BACKGROUND

The statements herein only provide background information related to the present application, and do not necessarily constitute related art.

With the development and advancement of science and technology, liquid crystal displays have become the mainstream products of displays due to their advantages such as thin body, power saving, and low radiation, and have been widely used. Most of the liquid crystal displays on the market are backlit liquid crystal displays, which include liquid crystal panels and backlight modules. The working principle of the liquid crystal panel is to place liquid crystal molecules in two parallel glass substrates, and apply a drive voltage on the two glass substrates to control the rotation direction of the liquid crystal molecules, so as to refract light from the backlight module to produce images.

The thin film transistor-liquid crystal display (TFT-LCD) has gradually occupied a leading position in the display field due to its low power consumption, excellent image quality, and high production yield. Similarly, the TFT-LCD includes a liquid crystal panel and a backlight module. The liquid crystal panel includes a color filter substrate (CF substrate), a thin film transistor substrate (TFT substrate), and a mask. There are transparent electrodes on opposite inner sides of the foregoing substrates. A layer of liquid crystal molecules (Liquid Crystal, LC) is sandwiched between two substrates.

Because liquid crystal response consumes time, after data is refreshed, it usually takes a period of time before a liquid crystal can rotate to a position corresponding to the data. Therefore, the overdrive technology is used in the LCD panel. At present, when debugging an overdrive brightness value look-up table, the software uses an exhaustive test method to find appropriate values in the look-up table. The bigger problem is that the exhaustive method is time-consuming.

SUMMARY

The objective of the present application is to provide methods for debugging and using an overdrive brightness value look-up table, and a display panel, so as to effectively shorten time required for debugging an overdrive look-up table.

The present application provides a method for debugging an overdrive brightness value look-up table, including:

measuring actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table, where the measurement of each actual brightness value includes the following process: measuring an actual brightness value of the current frame by using an optical device with the gray scale M as the gray scale of the previous frame and with the gray scale N as the target gray scale of the current frame.

The present application further discloses a method for using an overdrive brightness value look-up table, where the overdrive brightness value look-up table is obtained through debugging using any one of the methods for debugging an overdrive brightness value look-up table disclosed in the present application;

the using method includes the following steps:

determining a target gray scale N of a current frame, and finding a corresponding actual brightness value as a target brightness value from the overdrive brightness value look-up table with the gray scale N as a gray scale of a previous frame and with the gray scale N as the target gray scale of the current frame;

determining a gray scale M of the previous frame, and finding an actual brightness value corresponding to a gray scale X from the overdrive brightness value look-up table with the gray scale M as the gray scale of the previous frame and with the gray scale X as a gray scale of the current frame, so that the actual brightness value of the gray scale X matches the target brightness value and the gray scale X is found; and replacing the gray scale N with the gray scale X as an actual gray scale of the current frame to drive a display panel.

The present application further discloses a display panel, where the display panel includes an overdrive brightness value look-up table and a timing control chip for storing the overdrive brightness value look-up table.

The inventor's undisclosed method for debugging a look-up table to be adjusted is an exhaustive test method. That is, a gray scale M to gray scales 0, 1, 2, 3, 4, . . . , and 255 are exhaustively tested to obtain a gray scale whose brightness is closer to that of a gray scale N to the gray scale N as a value in the look-up table. To adjust one value in the look-up table, the exhaustive test needs to be performed 65536 (256*256) times before one complete value in the overdrive look-up table can be obtained through debugging. To debug a complete look-up table, the exhaustive test needs to be performed 18939904 times, which consumes a lot of manpower and material resources. However, at the debugging stage of the overdrive brightness value look-up table in the present application, actual brightness is measured respectively by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and all actual brightness values are correspondingly recorded in the overdrive brightness value look-up table. In this way, the obtained overdrive brightness value look-up table includes the actual brightness values corresponding to various gray scale changes, and these brightness values can be used to find corresponding overdrive gray scales or overdrive voltage values during subsequent overdrive look-up. This greatly reduces quantities of measurements and tests while ensuring the overdrive look-up function, thereby shortening debugging time, greatly reducing manpower and material resources and production costs, and improving production efficiency.

BRIEF DESCRIPTION OF DRAWINGS

The included drawings are intended to provide a further understanding of one or more embodiments of the present application, which constitute a part of the specification. The drawings are used to illustrate the implementations of the present application, and together with the text description, explain the principle of the present application. Clearly, the drawings in the following description are merely some embodiments of the present application. A person of ordinary skill in the art can derive other drawings from these drawings without creative efforts. In the drawings.

DETAILED DESCRIPTION OF EMBODIMENTS

Figure 1:
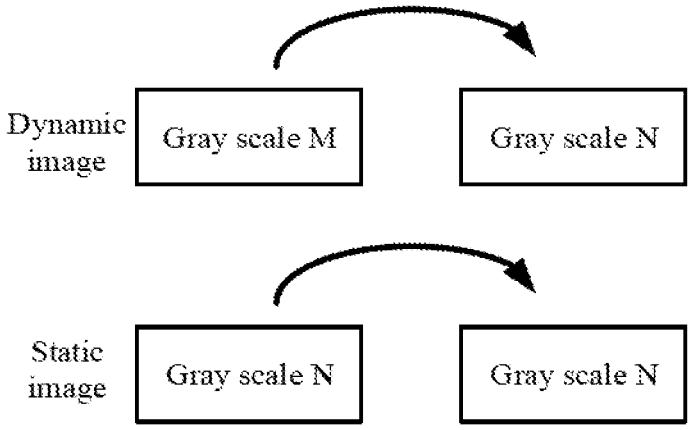
FIG. 1 is a schematic diagram of an undisclosed method for debugging an overdrive look-up table according to the present application.

The specific structure and function details disclosed herein are merely representative, and are intended to describe one or more example embodiments of the present application. However, the present application can be specifically implemented in many alternative forms, and should not be interpreted to be limited to one or more embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships shown in the drawings, for ease of the description of the present application and simplifying the description only, rather than indicating or implying that the indicated apparatus or element must have a particular orientation or be constructed and operated in a particular orientation. Therefore, these terms should not be understood as a limitation on the present application. In addition, the terms such as "first" and "second" are merely for a descriptive purpose, and cannot be understood as indicating or implying a relative importance, or implicitly indicating a quantity of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be noted that, unless otherwise specified and defined, the terms "install", "connected with", and "connected to" should be comprehended in a broad sense. For example, these terms may be comprehended as being fixedly connected, detachably connected or integrally connected; mechanically or electrically connected; or directly connected or indirectly connected through an intermediate medium, or in internal communication between two elements. The specific meanings about the foregoing terms in the present application may be understood by a person of ordinary skill in the art depending on specific circumstances.

The terms used herein are merely for the purpose of describing one or more specific embodiments, and are not intended to limit one or more example embodiments. As used herein, the singular forms "a" and "an" are intended to include the plural forms as well, unless otherwise indicated in the context clearly. It should be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The following further describes the present application with reference to drawings and one or more example embodiments.

Figure 2:
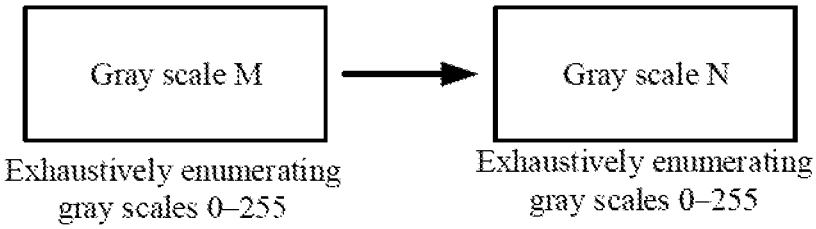
FIG. 2 is a schematic diagram of exhaustive enumeration for debugging a value in an undisclosed method for debugging an overdrive look-up table according to the present application.

FIG. 1 is a schematic diagram of an undisclosed method for debugging an overdrive look-up table according to the present application. FIG. 2 is a schematic diagram of exhaustive enumeration for debugging a value in an undisclosed method for debugging an overdrive look-up table according to the present application. FIG. 1 and FIG. 2 show an undisclosed solution for debugging an overdrive look-up table.

Because liquid crystal response consumes time, after data is refreshed, it usually takes a period of time before a liquid crystal can rotate to a position corresponding to the data. Therefore, the overdrive technology is used in an LCD panel. When an overdrive gray scale look-up table is debugged, an exhaustive test method is used to find appropriate values in the look-up table. The bigger problem is that the exhaustive method is time-consuming.

(1) A process of debugging an overdrive gray scale look-up table is as follows:

FIG. 1 is a schematic diagram of a used but undisclosed method for debugging an overdrive brightness value look-up table. A rule for debugging an overdrive brightness value look-up table is that regardless of a gray scale of a previous frame of data, a liquid crystal of a gray scale of a current frame needs to rotate to a correct position. For example, in FIG. 1, when the gray scale of the previous frame is a gray scale M and the gray scale of the current frame is a gray scale N, it needs to be identified that brightness from the gray scale M to how many gray scales is equal to brightness from the gray scale N to the gray scale N.

FIG. 2 is a schematic diagram of exhaustive enumeration for debugging a value in a used but undisclosed method for debugging an overdrive brightness value look-up table. A conventional method for adjusting a look-up table is an exhaustive test method. That is, a gray scale M to gray scales 0, 1, 2, 3, 4, . . . , and 255 are exhaustively tested to obtain a gray scale whose brightness is closer to that of a gray scale N to the gray scale N as a value in the look-up table. To adjust one value in the look-up table, the exhaustive test needs to be performed 65536 (256*256) times before one complete value in the overdrive gray scale look-up table can be obtained through debugging.

To debug a complete look-up table, the exhaustive test needs to be performed 18939904 (65536*256) times, which consumes a lot of manpower and material resources.

(2) A process of looking up the foregoing overdrive gray scale look-up table is as follows:

To find the gray scale M, look-up needs to be performed at most 256 times, and on this basis, to find the gray scale N, look-up needs to be performed at most 256 times, that is, look-up needs to be performed at most 256+256 times to identify that brightness of the gray scale M to how many gray scales is equal to brightness of the gray scale N to the gray scale N. Referring to the overdrive gray scale look-up table shown in Table 1 (some data in the table may not be consistent with that in an actual situation, which does not limit the present application, and is only for reference), for example, in the look-up table, the previous frame is 32 gray scales and the current frame is 48 gray scales. The corresponding value is 7, that is, a drive voltage value corresponding to 39 (32+7) gray scales needs to be used as an overdrive voltage value. Table 1 is shown as follows:

TABLE 1

Overdrive gray scale look-up table

Current Frame [7:0]

| | | | | | | | | | | | | | | | | | |
|---|---|---|---|---|---|---|---|---|---|---|---|---|---|---|---|---|---|
| 256 | 0 | 0 | 0 | 0 | 0 | 0 | 0 | 0 | 0 | 0 | 0 | 0 | 0 | 0 | 0 | 0 | 0 |
| 240 | 15 | 15 | 15 | 15 | 15 | 13 | 12 | 11 | 10 | 9 | 8 | 7 | 6 | 5 | 4 | 0 | −5 |
| 224 | 23 | 20 | 19 | 18 | 16 | 15 | 13 | 12 | 10 | 9 | 7 | 6 | 5 | 3 | 0 | −6 | −10 |
| 208 | 31 | 28 | 26 | 25 | 23 | 21 | 19 | 17 | 15 | 13 | 10 | 8 | 5 | 0 | −6 | −11 | −17 |
| 192 | 40 | 36 | 34 | 32 | 30 | 26 | 23 | 19 | 16 | 13 | 9 | 6 | 0 | −6 | −10 | −16 | −24 |
| 176 | 50 | 44 | 41 | 37 | 32 | 28 | 23 | 19 | 14 | 10 | 5 | 0 | −7 | −12 | −17 | −25 | −33 |
| 160 | 60 | 51 | 46 | 41 | 35 | 29 | 24 | 18 | 13 | 7 | 0 | −6 | −11 | −17 | −22 | −33 | −42 |
| 144 | 67 | 55 | 48 | 42 | 35 | 27 | 19 | 13 | 7 | 0 | −8 | −15 | −22 | −28 | −36 | −47 | −59 |
| 128 | 74 | 59 | 52 | 44 | 34 | 26 | 17 | 10 | 0 | −8 | −16 | −24 | −31 | −39 | −47 | −59 | −72 |
| 112 | 80 | 62 | 52 | 43 | 32 | 21 | 10 | 0 | −11 | −20 | −29 | −37 | −45 | −53 | −82 | −75 | −87 |
| 96 | 84 | 63 | 52 | 41 | 27 | 13 | 0 | −12 | −22 | −32 | −42 | −50 | −59 | −67 | −74 | −81 | −85 |
| 80 | 86 | 62 | 47 | 34 | 16 | 0 | −14 | −26 | −38 | −48 | −57 | −62 | −66 | −69 | −70 | −72 | −74 |
| 64 | 79 | 54 | 36 | 19 | 0 | −18 | −34 | −43 | −49 | −52 | −54 | −56 | −57 | −58 | −59 | −60 | −61 |
| 48 | 27 | 14 | 7 | 0 | −8 | −11 | −14 | −18 | −22 | −22 | −24 | −26 | −30 | −34 | −36 | −38 | −40 |
| 32 | 18 | 8 | 0 | −7 | −7 | −12 | −15 | −16 | −16 | −17 | −17 | −18 | −20 | −22 | −22 | −24 | −24 |
| 16 | 9 | 0 | −3 | −5 | −4 | −5 | −5 | −6 | −6 | −6 | −6 | −8 | −8 | −10 | −10 | −12 | −12 |
| 0 | 0 | 0 | 0 | 0 | 0 | 0 | 0 | 0 | 0 | 0 | 0 | 0 | 0 | 0 | 0 | 0 | 0 |
| | 0 | 16 | 32 | 48 | 64 | 80 | 96 | 112 | 128 | 144 | 160 | 17$ | 192 | 208 | 224 | 240 | 256 |

At the debugging stage of the foregoing overdrive brightness value look-up table, a lot of manpower and material resources are wasted. Therefore, the present application provides methods for debugging and using an overdrive brightness value look-up table that have been researched and developed.

Figure 3:
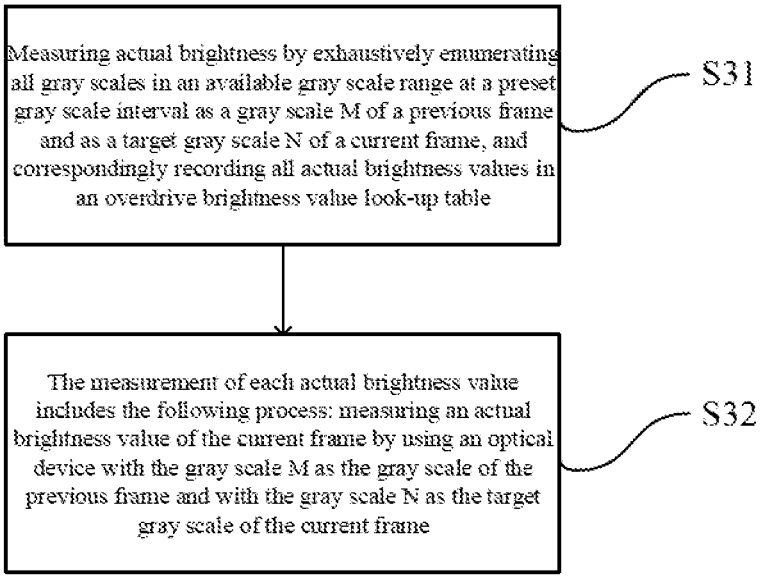
FIG. 3 is a first flowchart of a method for debugging an overdrive brightness value look-up table according to the present application.
Figure 4:
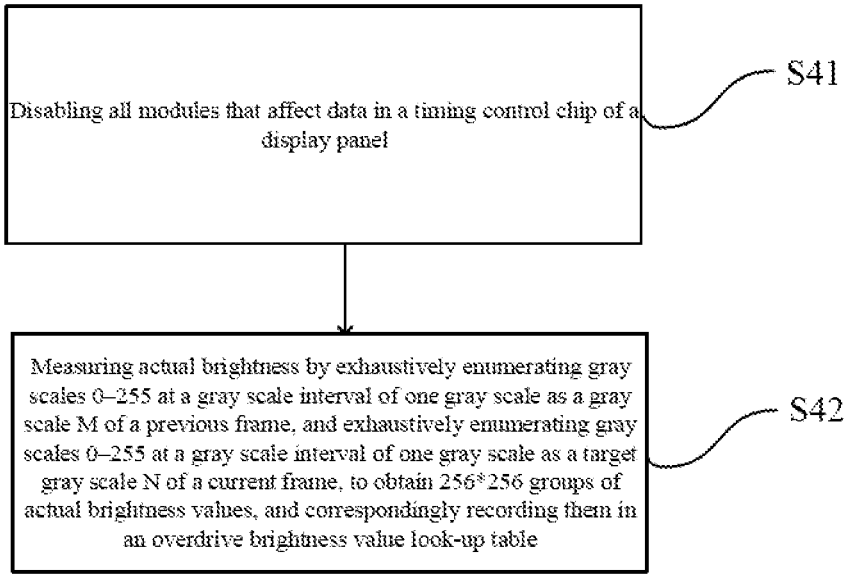
FIG. 4 is a second flowchart of a method for debugging an overdrive brightness value look-up table according to the present application.

FIG. 3 is a first flowchart of a method for debugging an overdrive brightness value look-up table according to the present application. FIG. 4 is a second flowchart of a method for debugging an overdrive brightness value look-up table according to the present application. References can be made to FIG. 3 and FIG. 4.

The present application provides a method for debugging an overdrive brightness value look-up table, including the following steps:

S31: Measure actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly record all actual brightness values in the overdrive brightness value look-up table.

S32: The measurement of each actual brightness value includes the following process: measuring an actual brightness value of the current frame by using an optical device with the gray scale M as the gray scale of the previous frame and with the gray scale N as the target gray scale of the current frame.

The available gray scale range may be gray scales 0-255, or other gray scales. In addition, the gray scale interval may be one gray scale, two gray scales, three gray scales, or another interval. After the measurement, all actual brightness values can be obtained through debugging by calculating differences based on the measurement results. Certainly, the gray scale interval should not be too large. Otherwise, a difference between the calculated actual brightness value and that of an actual situation is too large, which affects a display effect.

The method for debugging an overdrive brightness value look-up table in the present application corresponds to an undisclosed method for debugging a look-up table to be adjusted, and the debugging method is an exhaustive test method. That is, a gray scale M to gray scales 0, 1, 2, 3, 4, . . . , and 255 are exhaustively tested to obtain a gray scale whose brightness is closer to that of a gray scale N to the gray scale N as a value in the look-up table. To adjust one value in the look-up table, the exhaustive test needs to be performed 65536 (256*256) times before one complete value in the overdrive look-up table can be obtained through debugging. To debug a complete look-up table, the exhaustive test needs to be performed 18939904 times, which consumes a lot of manpower and material resources. However, at the debugging stage of the overdrive brightness value look-up table in the present application, actual brightness is measured respectively by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and all actual brightness values are correspondingly recorded in the overdrive brightness value look-up table. In this way, the obtained overdrive brightness value look-up table includes the actual brightness values corresponding to various gray scale changes, and these brightness values can be used to find corresponding overdrive gray scales or overdrive voltage values during subsequent overdrive look-up. This greatly reduces quantities of measurements and tests while ensuring the overdrive look-up function, thereby shortening debugging time, greatly reducing manpower and material resources and production costs, and improving production efficiency.

In the foregoing steps, the preset gray scale interval is one gray scale; the gray scale range is gray scales 0-255; and the step of measuring actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table includes the following steps:

S41: When measuring an actual brightness value by using an optical device, first disable all circuits that affect data in a timing control chip of a display panel.

S42: Measure actual brightness by exhaustively enumerating gray scales 0-255 at a gray scale interval of one gray scale as a gray scale M of a previous frame, and exhaustively enumerating gray scales 0-255 at a gray scale interval of one gray scale as a target gray scale N of a current frame, to obtain 256*256 groups of actual brightness values, and correspondingly record all actual brightness values in an overdrive brightness value look-up table.

To prevent displaying of the panel from being affected by other factors and to fully present original characteristics of the panel, during debugging, all circuits that affect the data in the timing control chip of the panel are disabled. The circuits that mainly affect the data include but are not limited to a digital gamma circuit, a color management circuit, an optical compensation (Demura) circuit, etc. At the debugging stage of the overdrive brightness value look-up table, actual brightness is measured respectively by exhaustively enumerating all gray scales in a range of gray scales 0-255 at a gray scale interval of one gray scale as a gray scale M of a previous frame, and exhaustively enumerating all gray scales in an available gray scale range at a gray scale interval of one gray scale as a target gray scale N of a current frame, and all actual brightness values are correspondingly recorded in the overdrive brightness value look-up table. In this way, the obtained overdrive brightness value look-up table includes the actual brightness values corresponding to various gray scale changes, and these brightness values can be used to find corresponding overdrive gray scales or overdrive voltage values during subsequent overdrive look-up. This greatly reduces quantities of measurements and tests while ensuring the overdrive look-up function, thereby shortening debugging time, greatly reducing manpower and material resources and production costs, and improving production efficiency. Specifically, an amount of data to be measured in the debugging method in the present application is 1/256 of that in the inventor's undisclosed method for debugging an overdrive look-up table.

Figure 5:
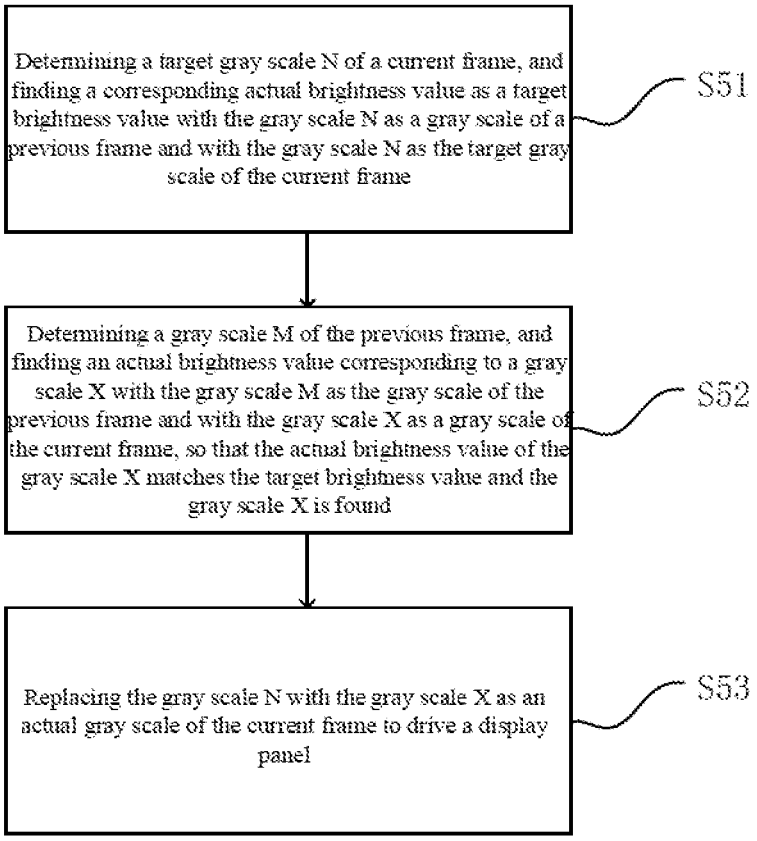
FIG. 5 is a flowchart of a method for using an overdrive brightness value look-up table according to the present application.

FIG. 5 is a first flowchart of a method for using an overdrive brightness value look-up table according to the present application. Referring to FIG. 5, the present application further discloses a method for using an overdrive brightness value look-up table, where the overdrive brightness value look-up table is obtained through debugging using any one of the methods for debugging an overdrive brightness value look-up table disclosed in the present application.

The using method includes the following steps:

S51: Determine a target gray scale N of a current frame, and find a corresponding actual brightness value as a target brightness value from the overdrive brightness value look-up table with the gray scale N as a gray scale of a previous frame and with the gray scale N as the target gray scale of the current frame.

S52: Determine a gray scale M of the previous frame, and find an actual brightness value corresponding to a gray scale X from the overdrive brightness value look-up table with the gray scale M as the gray scale of the previous frame and with the gray scale X as a gray scale of the current frame, so that the actual brightness value of the gray scale X matches the target brightness value and the gray scale X is found.

S53: Replace the gray scale N with the gray scale X as an actual gray scale of the current frame to drive a display panel.

The overdrive brightness value look-up table can be used to look up and compare actual brightness values from the gray scale M of the previous frame to the gray scale X, so that the actual brightness value of the gray scale X matches the target brightness value, so as to find the gray scale X and replace the gray scale N with the gray scale X as the actual gray scale of the current frame to drive the display panel. This using method provides an overdrive look-up method with a different technical concept based on the overdrive brightness value look-up table, and basically achieves the technical effects of common technologies.

Further, the step of determining a gray scale M of the previous frame, and finding an actual brightness value corresponding to a gray scale X from the overdrive brightness value look-up table with the gray scale M as the gray scale of the previous frame and with the gray scale X as a gray scale of the current frame, so that the actual brightness value of the gray scale X matches the target brightness value and the gray scale X is found includes:

presetting a matching threshold, where when a difference between the actual brightness value of the gray scale X and the target brightness value is less than or equal to the matching threshold, the actual brightness value of the gray scale X matches the target brightness value.

In the process of using the overdrive brightness value look-up table, the actual brightness value of the actual gray scale X of the current frame to be looked up does not have to be equal to the target brightness value. It is considered that the actual brightness value of the gray scale X matches the target brightness value provided that the difference between the actual brightness value of the gray scale X and the target brightness value is within a range of the matching threshold. This avoids a case in which the actual gray scale X of the current frame cannot be found from the overdrive look-up table.

Specifically, the step of finding the gray scale X includes self-learning steps:

creating a self-learning overdrive look-up table; and detecting whether a look-up result with the gray scale M as the gray scale of the previous frame, with the gray scale N as the target gray scale of the current frame, and with the gray scale X as the actual gray scale of the current frame appears for the first time; and if the look-up result with the gray scale M as the gray scale of the previous frame, with the gray scale N as the target gray scale of the current frame, and with the gray scale X as the actual gray scale of the current frame appears for the first time, recording the look-up result in the self-learning overdrive look-up table with the gray scale M as the gray scale of the previous frame, with the gray scale N as the target gray scale of the current frame, and with the gray scale X as the actual gray scale of the current frame.

The self-learning function is added during use of overdrive brightness value look-up. Specifically, a self-learning overdrive look-up table is created, and overdrive look-up information that appears for the first time and a corresponding result are updated into the self-learning overdrive look-up table. In this way, during the next overdrive look-up, the calculation and comparison process cannot be repeated. On the basis of shortening the time required for debugging the overdrive brightness value look-up table and improving the debugging efficiency, the look-up time for the overdrive look-up action is shortened. Because the overdrive look-up action is relatively scattered, and look-up of some gray scale changes may probably never be used once, the overall time consumption of the solution of the present application is lower than that of the inventor's undisclosed methods for debugging and using an overdrive look-up table. In addition, because time is dispersed, time and manpower are dispatched more reasonably, and a good use effect is achieved.

The self-learning overdrive look-up table and the overdrive brightness value look-up table are recorded in forms of the identical data structure. When a value in the self-learning overdrive look-up table is generated, the value is directly marked as the actual gray scale of the current frame, and is recorded in the overdrive brightness value look-up table to overwrite and replace the corresponding actual brightness value. The self-learning function is added during use of overdrive brightness value look-up. Specifically, a self-learning overdrive look-up table is created. The self-learning overdrive look-up table and the overdrive brightness value look-up table are recorded in forms of the identical data structure. Then, when a value in the self-learning overdrive look-up table is generated each time, the value is directly marked as the actual gray scale of the current frame, and is recorded in the overdrive brightness value look-up table to overwrite and replace the corresponding actual brightness value. In this way, the calculation and comparison operations are only required for the first look-up. Later, after the actual brightness value is changed to the actual gray scale of the current frame, the overdrive look-up can be completed more quickly. Because the time required for the calculation and comparison is dispersed, reasonable allocation of time is implemented, and the overall time consumption is reduced, helping improve efficiency.

Before the step of determining a target gray scale N of a current frame, and finding a corresponding actual brightness value as a target brightness value from the overdrive brightness value look-up table with the gray scale N as a gray scale of a previous frame and with the gray scale N as the target gray scale of the current frame, the method further includes the following steps:

detecting whether the look-up with the gray scale M as the gray scale of the previous frame and with the gray scale N as the target gray scale of the current frame is the first look-up;

if the look-up with the gray scale M as the gray scale of the previous frame and with the gray scale N as the target gray scale of the current frame is the first look-up, jumping to the overdrive brightness value look-up table for overdrive look-up; or if the look-up with the gray scale M as the gray scale of the previous frame and with the gray scale N as the target gray scale of the current frame is not the first look-up, jumping to the self-learning overdrive look-up table for overdrive look-up.

Before the overdrive look-up table is looked up, it is detected whether the look-up with the gray scale M as the gray scale of the previous frame and with the gray scale N as the target gray scale of the current frame is the first look-up, and if the look-up with the gray scale M as the gray scale of the previous frame and with the gray scale N as the target gray scale of the current frame is the first look-up, the overdrive brightness value look-up table is jumped to for overdrive look-up. In this way, for each group of gray scale changes, the overdrive brightness value look-up table only needs to be jumped to the first look-up, and then calculation and comparison operations are performed. Later, the actual gray scale of the current frame can be quickly found from the self-learning overdrive look-up table, and then the overdrive look-up can be completed more quickly. Because the time required for the calculation and comparison is dispersed, reasonable allocation of time is implemented, and the overall time consumption is reduced, helping improve efficiency.

The self-learning overdrive look-up table and the overdrive brightness value look-up table are independently recorded in forms of different data structures. The self-learning function is added during use of overdrive brightness value look-up. Specifically, a self-learning overdrive look-up table is created. The self-learning overdrive look-up table and the overdrive brightness value look-up table are independently recorded in forms of different data structures, which avoids confusion between data and reduces difficulty of programming, etc. When a value in the self-learning overdrive look-up table is generated each time, the value is directly marked as the actual gray scale of the current frame, and is recorded in the self-learning overdrive look-up table. In this way, the calculation and comparison operations are only required for the first look-up. Later, after the actual brightness value is changed to the actual gray scale of the current frame, the overdrive look-up can be completed more quickly. Because the time required for the calculation and comparison is dispersed, reasonable allocation of time is implemented, and the overall time consumption is reduced, helping improve efficiency.

Figure 6:
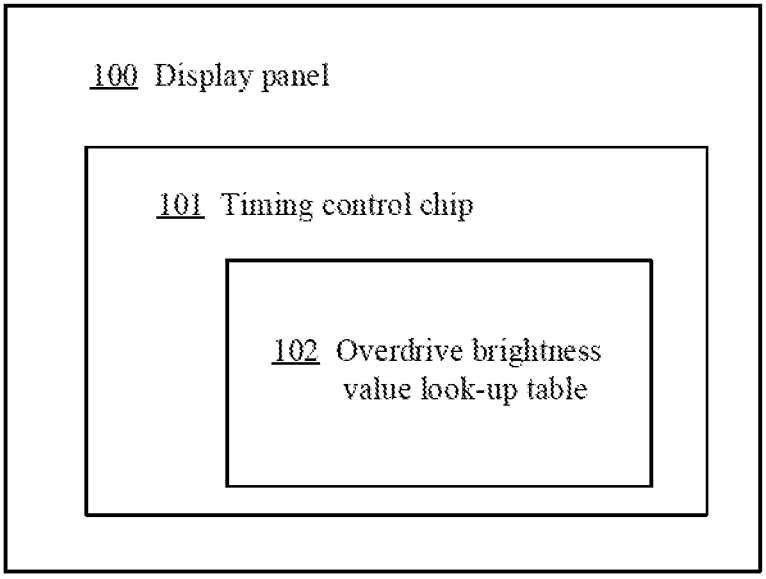
FIG. 6 is a schematic diagram of a display panel according to the present application.

FIG. 6 is a schematic diagram of a display panel according to the present application. Referring to FIG. 6, the present application further discloses a display panel 100, including an overdrive brightness value look-up tables 102 described in any aspect disclosed in the present application, and a timing control chip 101 for storing the overdrive brightness value look-up table 102.

A display panel of the inventor uses a new type of overdrive brightness value look-up table. Prior to the overdrive brightness value look-up table, there is an undisclosed method for debugging a look-up table to be adjusted, which is an exhaustive test method. That is, a gray scale M to gray scales 0, 1, 2, 3, 4, . . . , and 255 are exhaustively tested to obtain a gray scale whose brightness is closer to that of a gray scale N to the gray scale N as a value in the look-up table. To adjust one value in the look-up table, the exhaustive test needs to be performed 65536 (256*256) times before one complete value in the overdrive look-up table can be obtained through debugging. To debug a complete look-up table, the exhaustive test needs to be performed 18939904 times, which consumes a lot of manpower and material resources. However, at the debugging stage of the overdrive brightness value look-up table in the present application, actual brightness is measured respectively by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and all actual brightness values are correspondingly recorded in the overdrive brightness value look-up table. In this way, the obtained overdrive brightness value look-up table includes the actual brightness values corresponding to various gray scale changes, and these brightness values can be used to find corresponding overdrive gray scales or overdrive voltage values during subsequent overdrive look-up. This greatly reduces quantities of measurements and tests while ensuring the overdrive look-up function, thereby shortening debugging time, greatly reducing manpower and material resources and production costs, and improving production efficiency.

The panel in the present application may be a Twisted Nematic (TN) panel, an In-Plane Switching (IPS) panel, or a Multi-domain Vertical Alignment (VA) panel, or certainly may be another type of panel, when applicable.

The foregoing content further describes the present application in detail with reference to one or more specific optional embodiments, and the specification should not be construed as a limitation on the specific implementation of the present application. A person of ordinary skill in the art to which the present application belongs may make some simple derivations or replacements without departing from the idea of the present application, and the derivations or replacements should all fall within the protection scope of the present application.

What is claimed is:

1. A method for debugging an overdrive brightness value look-up table, comprising:

measuring actual brightness by exhaustively enumerating all gray scales m an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table, wherein the measurement of each actual brightness value comprises the following process:

measuring an actual brightness value of the current frame by using an optical device with the gray scale M as the gray scale of the previous frame and with the gray scale N as the target gray scale of the current frame; and wherein when an actual brightness value is measured by using the optical device, all circuits that affect data in a timing control chip of a display panel are first disabled.

2. The method for debugging an overdrive brightness value look-up table according to claim 1, wherein the preset gray scale interval is one gray scale; the gray scale range is gray scales 0-255; and the step of measuring actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table comprises:

measuring actual brightness by exhaustively enumerating gray scales 0-255 at a gray scale interval of one gray scale as the gray scale M of the previous frame, and exhaustively enumerating gray scales 0-255 at a gray scale interval of one gray scale as the target gray scale N of the current frame, to obtain 256*256 groups of actual brightness values, and correspondingly recording all actual brightness values in the overdrive brightness value look-up table.

3. The method for debugging an overdrive brightness value look-up table according to claim 2, wherein a difference between measurement results is calculated, and all actual brightness values are obtained through debugging and correspondingly recorded in the overdrive brightness value look-up table.

4. The method for debugging an overdrive brightness value look-up table according to claim 1, wherein the preset gray scale interval is two gray scales; the gray scale range is gray scales 0-255; and the step of measuring actual brightness by exhaustively enumerating all gray scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table comprises:

measuring actual brightness by exhaustively enumerating gray scales 0-255 at a gray scale interval of one gray scale as the gray scale M of the previous frame, and exhaustively enumerating gray scales 0-255 at a gray scale interval of one gray scale as the target gray scale N of the current frame, to obtain 256*256 groups of actual brightness values, and correspondingly recording all actual brightness values in the overdrive brightness value look-up table.

5. The method for debugging an overdrive brightness value look-up table according to claim 1, wherein the circuits that affect the data comprise a digital gamma circuit, a color management circuit, and an optical compensation circuit.

6. A method for using an overdrive brightness value look-up table, wherein the overdrive brightness value look-up table is obtained through debugging using a method for debugging an overdrive brightness value look-up table;

the method for debugging an overdrive brightness value look-up table comprises:

measuring actual brightness by exhaustively enumerating all gay scales in an available gray scale range at a preset gray scale interval as a gray scale M of a previous frame, and exhaustively enumerating all the gray scales in the available gray scale range at the preset gray scale interval as a target gray scale N of a current frame, and correspondingly recording all actual brightness values in the overdrive brightness value look-up table, wherein the measurement of each actual brightness value comprises the following process: measuring an actual brightness value of the current frame by using an optical device with the gray scale M as the gray scale of the previous frame and with the gray scale N as the target gray scale of the current frame;

die using method comprises the following steps:

determining a target gray scale N of a current frame, and finding a corresponding actual brightness value as a target brightness value from the overdrive brightness value look-up table with the gay scale N as a gray scale of a previous frame and with the gray scale N as the target gray scale of the current frame;

determining a gray scale M of the previous frame, and finding an actual brightness value corresponding to a gray scale X from the overdrive brightness value look-up table with the gray scale M as the gray scale of the previous frame and with the gray scale X as a gray scale of the current frame, so that the actual brightness value of the gray scale X matches the target brightness value and the gray scale X is found; and replacing die gray scale N with the gay scale X as an actual gray scale of the current frame to drive a display panel.

7. The method for using an overdrive brightness value look-up table according to claim 6, wherein the step of determining a gray scale M of the previous frame, and finding an actual brightness value corresponding to a gray scale X from the overdrive brightness value look-up table with the gray scale M as the gray scale of the previous frame and with die gray scale X as a gray scale of the current frame, so that the actual brightness value of the gray scale X matches the target brightness value and the gray scale X is found comprises:

presetting a matching threshold, wherein when a difference between the actual brightness value of the gray scale X and the target brightness value is less than or equal to the matching threshold, the actual brightness value of the gray scale X matches the target brightness value.

8. The method for using an overdrive brightness value look-up table according to claim 6, wherein the step of finding the gray scale X comprises self-learning steps:

creating a self-learning overdrive look-up table; and detecting whether a look-up result with the gray scale M as the gray scale of the previous frame, with the gray scale N as the target gray scale of the current frame, and with the gray scale X as the actual gray scale of the current frame appears for the first time; and if the look-up result with the gay scale M as the gray scale of the previous frame, with the gray scale N as the target gray scale of the current frame, and with the gray scale X as the actual gray scale of the current frame appears for the first time, recording the look-up result in the self-learning overdrive look-up table with the gray scale M as the gray scale of the previous frame, with the gray scale N as the target gray scale of the current frame, and with the gray scale X as the actual gay scale of the current frame.

9. The method for using an overdrive brightness value look-up table according to claim 8, wherein the self-learning overdrive look-up table and the overdrive brightness value look-rip table are recorded in forms of the identical data structure; and when a value in the s f-learning overdrive look-up table is generated, the value is directly marked as the actual gray scale of the current frame, and is recorded in the overdrive brightness value look-up table to overwrite and replace the corresponding, actual brightness value.

10. The method for using an overdrive brightness value look-up table according to claim 9, wherein the self-learning overdrive look-up table and the overdrive brightness value look-up table are independently recorded in forms of different data structures.

11. The method for using an overdrive brightness value look-up table according to claim 9, wherein the self-learning overdrive look-up table and the overdrive brightness value look-up table are recorded in forms of the identical data structure.

12. The method for using an overdrive brightness value look-up table according to claim 8, wherein the step of detecting Whether a look-up result with the gray scale M as the gray scale of the previous frame, with the gray scale N as the target gray scale of the current frame, and with the gray scale X as the actual gray scale of the current frame appears for the first time; and if the look-up result with the gray scale M as the gray scale of the previous frame, with the gray scale N as the target gray scale of the current frame, and with the gray scale X as the actual gray scale of the current frame appears for the first time, recording the look-up result in the self-learning overdrive look-up table with the gray scale M as the gray scale of the previous frame, with the gray scale N as the target gray scale of the current frame, and with the gray scale X as the actual gray scale of the current frame comprises:

updating overdrive look-up information that appears for the first time and a corresponding result into the self-learning overdrive look-up table.

13. The method for using an overdrive brightness value look-up table according to claim 8, wherein before the step of determining a target gray scale N of a current frame, and finding a corresponding actual brightness value as a target brightness value from the overdrive brightness value look-up table with the gray scale N as a gray scale of a previous frame and with the gray scale N as the target gray scale of the current frame, the method further comprises the following steps:

detecting whether the look-up with the gray scale M as the gray scale of the previous frame and with the gray scale N as the target gray scale of the current frame is the first look-up;

if the look-up with the gray scale M as the gray scale of the previous frame and with the gray scale N as the target gray scale of the current frame is the first look-up, jumping to the overdrive brightness value look-up table for overdrive look-up; or if the look-up with the gray scale M as the gray scale of the previous frame and with the gray scale N as the target gray scale of the current frame is not the first look-up, jumping to the self-learning overdrive look-up table for overdrive look-up.

14. A display panel, comprising an overdrive brightness value look-up table and a timing control chip for storing the overdrive brightness value look-up table, wherein at a debugging stage of the overdrive brightness value look-up table, actual brightness is measured respectively by exhaustively enumerating all gray scales in an available gray scale range at a preset gray scale interval as a gray scale M of a previous frame, and exhaustively enumerating all the gray scales m the available gray scale range at the preset gray scale interval as a target gray scale N of a current frame, and all actual brightness values are correspondingly recorded; and wherein when an actual brightness value is measured, all circuits that affect data in a timing control chip of a display panel are first disabled.

15. The display panel according to claim 14, wherein the overdrive brightness value look-up table comprises actual brightness values corresponding to various gray scale changes, and corresponding overdrive gray scale values are looked up based on the actual brightness values during subsequent overdrive look-up.

16. The display panel according to claim 14, wherein the timing control chip comprises a digital gamma circuit, a color management circuit, and an optical compensation circuit.

* * * * *